US008657225B2

(12) United States Patent
Hagleitner

(10) Patent No.: US 8,657,225 B2
(45) Date of Patent: Feb. 25, 2014

(54) PAPER DISPENSER

(76) Inventor: Hans Georg Hagleitner, Zell Am See (AT)

( * ) Notice: Subject to any disclaimer, the term of this patent is extended or adjusted under 35 U.S.C. 154(b) by 220 days.

(21) Appl. No.: 12/940,248

(22) Filed: Nov. 5, 2010

(65) Prior Publication Data

US 2011/0095063 A1 Apr. 28, 2011

Related U.S. Application Data

(63) Continuation of application No. PCT/AT2009/000185, filed on May 4, 2009.

(30) Foreign Application Priority Data

May 5, 2008 (AT) ..... A 712/2008

(51) Int. Cl.
*B65H 20/02* (2006.01)

(52) U.S. Cl.
USPC ..... 242/564.4

(58) Field of Classification Search
USPC ..... 242/564, 564.1, 564.2, 564.3, 564.4
See application file for complete search history.

(56) References Cited

U.S. PATENT DOCUMENTS

| | | | | |
|---|---|---|---|---|
| 3,737,087 | A * | 6/1973 | Rooklyn | 242/564.4 |
| 4,666,099 | A * | 5/1987 | Hoffman et al. | 242/564.1 |
| 6,092,451 | A | 7/2000 | Granger | |
| 6,412,655 | B1 | 7/2002 | Stuetzel et al. | |
| 7,114,677 | B2 * | 10/2006 | Formon et al. | 242/564.3 |
| 8,082,827 | B2 * | 12/2011 | Friesen et al. | 83/649 |
| 2007/0079684 | A1 | 4/2007 | Friesen et al. | |
| 2007/0176041 | A1 * | 8/2007 | Friesen et al. | 242/563 |
| 2011/0133019 | A1 * | 6/2011 | Keily et al. | 242/564 |

FOREIGN PATENT DOCUMENTS

WO 9958040 A1 11/1999

* cited by examiner

*Primary Examiner* — William A Rivera
(74) *Attorney, Agent, or Firm* — Laurence A. Greenberg; Werner H. Stemer; Ralph E. Locher

(57) ABSTRACT

A paper dispenser has a transport roller which can be alternatively rotated by a motor-driven mechanism or by a manually driven mechanism. A first coupling member is associated with the transport roller and respective second coupling members are associated with the two drive mechanisms. The two secondary coupling members are interconnected by a movable connecting element and can be alternatively engaged with the first coupling member.

17 Claims, 6 Drawing Sheets

PAPER DISPENSER

CROSS-REFERENCE TO RELATED APPLICATION

This application is a continuation, under 35 U.S.C. §120, of copending international application No. PCT/AT2009/000185, filed May 4, 2009, which designated the United States; this application also claims the priority, under 35 U.S.C. §119, of Austrian patent application No. A 712/2008, filed May 5, 2008; the prior applications are herewith incorporated by reference in their entirety.

BACKGROUND OF THE INVENTION

Field of the Invention

The invention relates to a paper dispenser with a conveying roller which can be alternately rotated by a motorized drive or by a manual drive. The conveying roller is assigned at least one first coupling member and the two drives are each assigned a second coupling member.

Older paper dispensers, in particular for paper hand towels or the like, generally have a manual drive which either comprises an outer actuating element, such as a pivoted lever or a crank, or is operated by the user pulling on the protruding end of the paper web. In the latter case, in particular, the conveying roller, over the circumference of which the paper web runs, preferably contains a knife device which, driven by the rotating conveying roller, cuts the paper web. However, the paper web may also be perforated, thus obviating the need for a blade, or a tear-off edge or tear-off toothing on the dispenser housing. In these cases, the conveying roller serves only to advance the appropriate length of the paper web.

More recent paper dispensers have a motorized drive and are generally set in motion by the user in a contactless manner. The options referred to above are also conceivable and known for a paper dispenser of this type.

The motorized drive is disadvantageous if the paper jams or the power is cut to the device. The issuing of paper may become more difficult or impossible. As a solution, patent publication No. US 2007/0079684 A describes a hybrid paper dispenser, the conveying roller of which can be driven by motor or, in the event of an emergency, manually. Both the manual drive via a slide and the motor drive contain a free wheel in each case, and therefore the two drives are consistently in physical engagement with the conveying roller.

SUMMARY OF THE INVENTION

It is accordingly an object of the invention to provide a paper dispenser which overcomes the above-mentioned disadvantages of the heretofore-known devices and methods of this general type and which provides for an alternative solution in which the second coupling members are connected by a movable coupling element and can be brought alternately into engagement with the first coupling member.

With the foregoing and other objects in view there is provided, in accordance with the invention, a paper dispenser, comprising:

- a conveying roller that can be driven either by a motorized drive or by a manual drive;
- a first coupling member connected to the conveying roller for actuating the conveying roller;
- a first secondary coupling member assigned to and actuated by a motorized drive and a second secondary coupling member assigned to and actuated by a manual drive; and

- a movable coupling element connecting the first and second secondary coupling members to one another, wherein the secondary coupling members may be brought alternatively into engagement with the first coupling member, to enable the conveying roller to be alternatively rotated by the motorized drive or by the manual drive.

In a preferred embodiment of a first exemplary embodiment, it is provided that all of the coupling members have toothings, in particular serrations. However, depending on the space conditions, other coupling members are also conceivable, for example friction couplings or the like, which can be alternately pressed onto the two end sides of the roller or act on the conveying roller via the circumference. In particular, in order to provide relatively large clearances, the second serrated coupling members are arranged in two axially offset planes such that they can never come into contact with each other. The first coupling member can then have a wider toothing and may comprise two toothings which then in particular differ in diameter, or else the coupling member may also be composed of two gear wheels.

The second coupling member of the manual drive (also referred to as the second secondary coupling member) may be a spur gear wheel which is mounted pivotably between an engagement position and rest position by means of a first two-armed lever, which is coupled to the coupling element and is mounted in the dispenser housing, and is mounted rotatably on the second lever arm of the first two-armed lever. The spur gear wheel can be assigned, for example, an outer crank or an outer handle such that it can be actuated in the engagement position, wherein, if an appropriate step-up ratio is provided, the conveying roller is rotated in proportion to the paper web length to be dispensed.

In a preferred embodiment, the second coupling member of the manual drive is a toothed segment which is mounted pivotably to a limited extent on the first two-armed lever. Since, by the pivoting of the toothed segment, the conveying roller can generally be rotated only about part of the paper length to be dispensed, a repetition is possible by the toothed segment, which, bearing against the two-armed lever by means of a stop, is carried along by the two-armed lever during the movement into the engagement position, buckles in the manner of a toggle lever during the counter movement and, as a result, is rapidly detached from the toothing without turning the conveying roller back. The toothed segment can then be returned into the starting position with the assistance of a spring or because of the force of gravity.

In the first exemplary embodiment, the second coupling member of the motorized drive (also referred to as the first secondary coupling member) is in particular a spur gear wheel which can be pivoted between an engagement position and a rest position by means of a second two-armed lever which is coupled to the coupling joint and is mounted in the dispenser housing. The spur gear wheel is arranged together with the motor and a possible intermediate gear on a plate pivotally mounted in the dispenser housing.

The coupling element connects the two two-armed levers in such a manner that they pivot approximately in the same direction or approximately parallel. However, the sequences of movement following the two two-armed levers differ since the toothed segment of the manual drive pivots about an angle which is as large as possible and is intended to engage in a toothing which is as small as possible, in order to obtain as large as possible an angle of rotation of the conveying roller while the pivoting of the spur gear wheel of the motorized drive is intended to be only insignificantly larger than the depth of the toothing since generally only restricted space conditions are provided.

Therefore, in a further preferred embodiment, in order to reduce the pivoting path of the motorized drive, a step-down intermediate lever is provided between the second lever arm of the second two-armed lever and the pivotable plate. In this embodiment, the intermediate lever coupled to the plate and the second arm of the second two-armed lever preferably form a toggle lever by means of which, at the beginning of the changeover from motorized drive to manual drive, during the initial displacement of the coupling element, the spur gear wheel is rapidly disengaged from the toothing of the first coupling element and pivots out less and less over the further portion of the displacement of the coupling element as far as the dead center of the toggle lever. If appropriate, the toggle lever may also move beyond the extended position until it stops in a further stable end position.

In a further preferred embodiment, a dedicated outer actuating element for the manual drive can be dispensed with, since the drive can be implemented via the coupling element which is coupled to the two two-armed levers and the movement of which takes place along an arc of a circle with only little curvature. For this purpose, the coupling element is assigned, for example, a slide which is provided in the lower region on the lower side of the dispenser and is acted upon by a restoring spring.

Other features which are considered as characteristic for the invention are set forth in the appended claims.

Although the invention is illustrated and described herein as embodied in a paper dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 6:
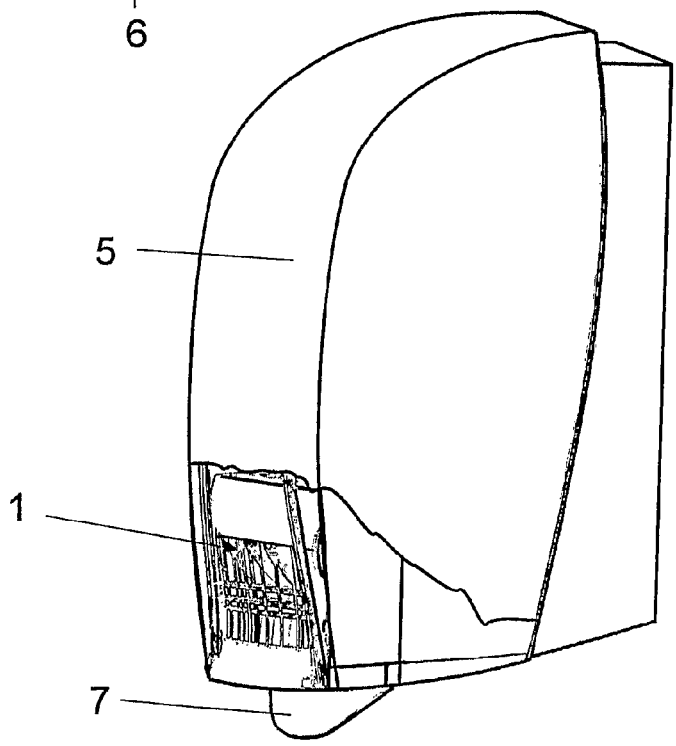
FIG. 6 is a perspective view of a partially broken-away paper dispenser.

Referring now to the figures of the drawing in detail and first to FIG. 6 thereof, the paper dispenser has a housing 5 in which a paper reel and preferably also a spare reel are located. A conveying roller 1 which can be driven by motor and alternatively manually is provided in the lower region, and an actuating element 7 for the manual drive is arranged on the lower side.

The figures show in detail only those parts of the different driving units of a paper dispenser that are required for understanding the present invention. These include a region of the dispenser housing 5 in which the conveying roller 1 and the drives which can be alternately used are held and mounted. The conveying roller 1 preferably contains a knife arrangement which is actuated by rotation of the conveying roller 1 and cuts off sheets from the non-illustrated paper web.

The paper dispenser is normally driven by a motor 23 which is set into motion, in particular contactlessly, after recognizing a user by means of a suitable proximity sensor and issues a sheet or a predetermined number of sheets.

If a malfunction occurs, for example when the power supply is interrupted, batteries are too weak, a paper jam occurs, etc., the motorized drive can be decoupled from the conveying roller 1 and replaced by a manual drive. In the exemplary embodiments illustrated in the drawings, only a single actuating element 7 is required for the changing over from motorized drive to manual drive and for the manual continued rotation of the conveying roller 1, the actuating element being displaceable on the lower side of the dispenser housing 5 counter to a restoring spring 8.

In the embodiments according to FIGS. 1 to 5, the conveying roller 1 has, at one end, two toothed rings 3, 4 which are arranged offset axially and differ in diameter. The toothed rings 3, 4 form a first coupling member 2 with which two secondary coupling members 12, 25 interact, as described in detail below. The actuating element 7 is assigned a coupling element 6 to which a first two-armed lever 10 and a second two-armed lever 17 are coupled. The levers 10 and 17 are pivotally mounted on the housing 5 about the axes 11 and 16, respectively.

The first two-armed lever 10 belongs to the manual drive and, at the free end thereof, supports a toothed segment 12, the toothing 14 of which interacts with the second toothed ring 4 of the conveying roller. The toothed segment 12 is mounted pivotably about an axis 13 and has a stop 15 (FIG. 4) which permits pivoting of the toothed segment 12 on the lever 10 between an extended position, which is illustrated in FIGS. 1 to 3, and a buckled position, shown in FIGS. 4 and 5.

The motor 23 is arranged, if appropriate together with an intermediate gear (not shown), on a pivotable plate 21 and has a driving gear wheel 25 with a serration 26 which interacts with the toothed ring 3 of the conveying roller 1.

The second two-armed lever 17 belongs to the motorized drive and, at the free end thereof, supports an intermediate lever 19 which is coupled to the plate 21 which is pivotable about the axis 22. The second arm of the two-armed lever 17 and the intermediate lever 19 form a toggle lever with two stable end positions which can be seen in FIGS. 1 and 3, wherein the return of the levers 17 and 19 into the position in FIG. 1 after the dead center is overcome is assisted by the spring 24 which acts on an extension of the plate 22 and on the housing 5.

Figure 1:
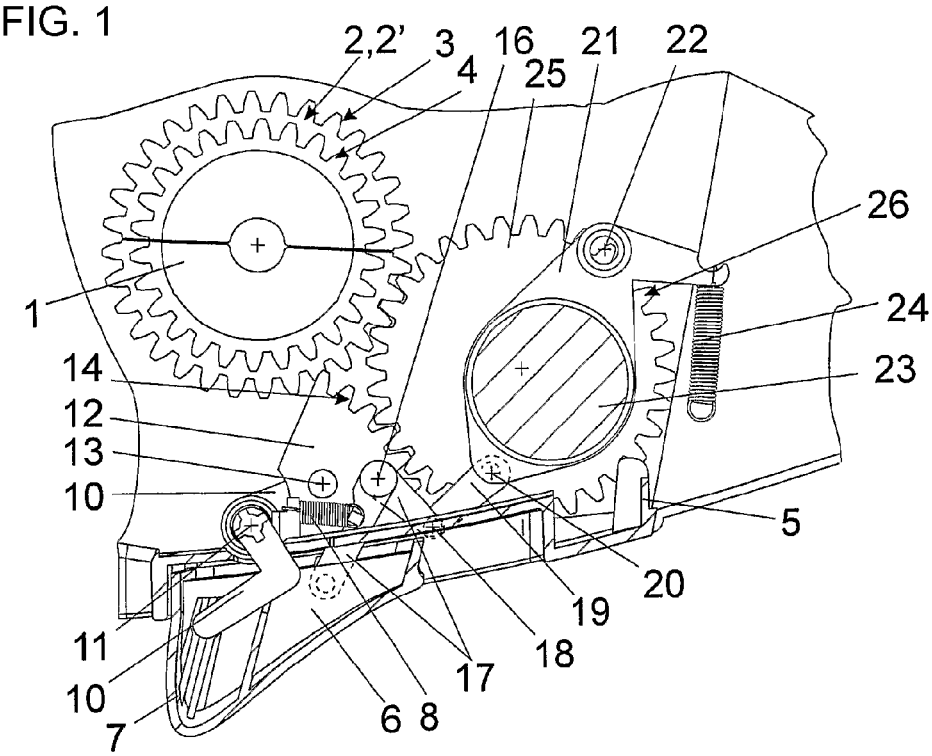
FIGS. 1 to 5 show five identical sections in five different positions of a first embodiment of the driving unit according to the invention, with FIGS. 1 and 3 illustrating the two engagement positions and FIGS. 2, 4, 5 illustrating intermediate positions in the displacement to and fro of the coupling element.
Figure 2:
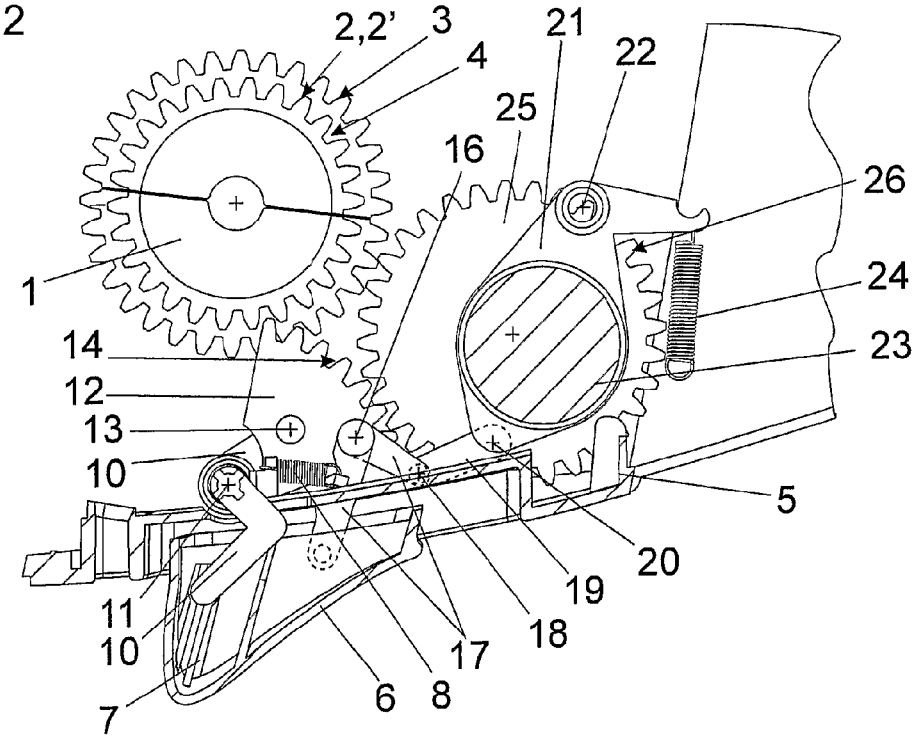
Figure 3:
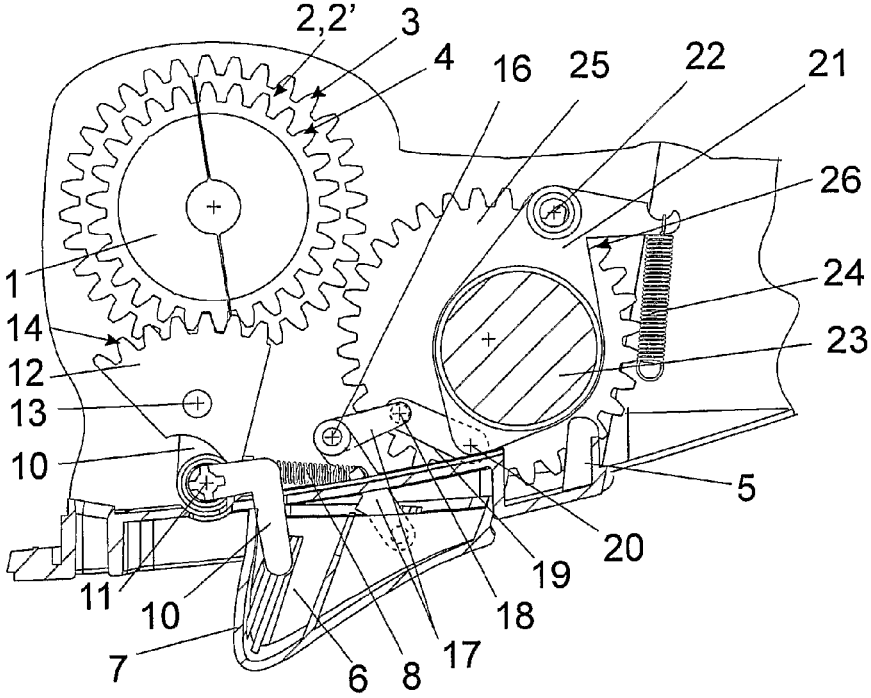

The manner of operation of the driving unit in FIGS. 1 to 5 is as follows: in the standard position according to FIG. 1, the motor 23 is in engagement via the driving gear wheel 25 with the toothed ring 3 on the conveying roller 1 which, when requested by a user, issues an end section of the paper web from the dispenser. In the process, the toothed segment 12 of the manual drive is permanently disengaged from the smaller toothed ring 4 of the first coupling member 2 on the conveying roller 1. If a manual drive is now possible or necessary, for example because of a power failure, paper jam or the like, a user presses on the actuating element 7 provided approximately centrally on the lower side of the paper dispenser housing 5. Owing to the dual support thereof on the two two-armed levers 10, 17, the coupling element 6 connected to the actuating element 7 pivots to the rear in a slight arc. At the beginning of the movement of the coupling element 6, the plate 21 is pivoted to the rear relatively rapidly about the axis 22 by the toggle lever formed from the second lever arm of the two-armed lever 17 and the intermediate lever 19, and the toothings 26 and 3 become disengaged, as can be seen from FIG. 2. At the same time, the toothed segment 12, which bears by way of the stop 15 thereof (FIG. 4) against the second lever arm of the two-armed lever 10, pivots up from the latter, such that the toothing 14 enters into engagement in the toothing 4.

If the coupling element 6 is moved further to the rear, the conveying roller 1 is rotated about a corresponding angle, as can be seen at the position of the diametric line in the conveying roller when comparing FIGS. 2 and 3. In this case, the motor 23 which has been pivoted out remains substantially in the position thereof, since although the axis of articulation 18 between the levers 17 and 19 necessarily also moves on an arc of a circle leading substantially upward, there is only a small horizontal displacement component.

The rotation of the conveying roller here may already be sufficient in order to remove a paper jam, and the change back to motorized drive can be made. Upon the return of the coupling element 6, which is acted upon by the spring 8, the motor 23 enters into engagement again with the toothing 3 of the first coupling member 2. The conveying roller is prevented from rotating back since the toothed segment 12 can yield about the axis 13 on the second arm of the two-armed lever 10, as is apparent from FIG. 4, and disengages from the toothed ring 4 (FIG. 5). As soon as it is free, it can pivot back into the starting position according to FIG. 1 under the action of the force of gravity or under the action of a spring (not shown).

If, depending on the step-up ratio between the toothings 14 and 4, the extent of the rotation of the conveying roller is not sufficient in order to dispense the desired length of paper, the user can repeat the operation, in which case the motor 23 is decoupled again, the toothed segment 12 is coupled in and the conveying roller 1 is rotated.

Figure 4:
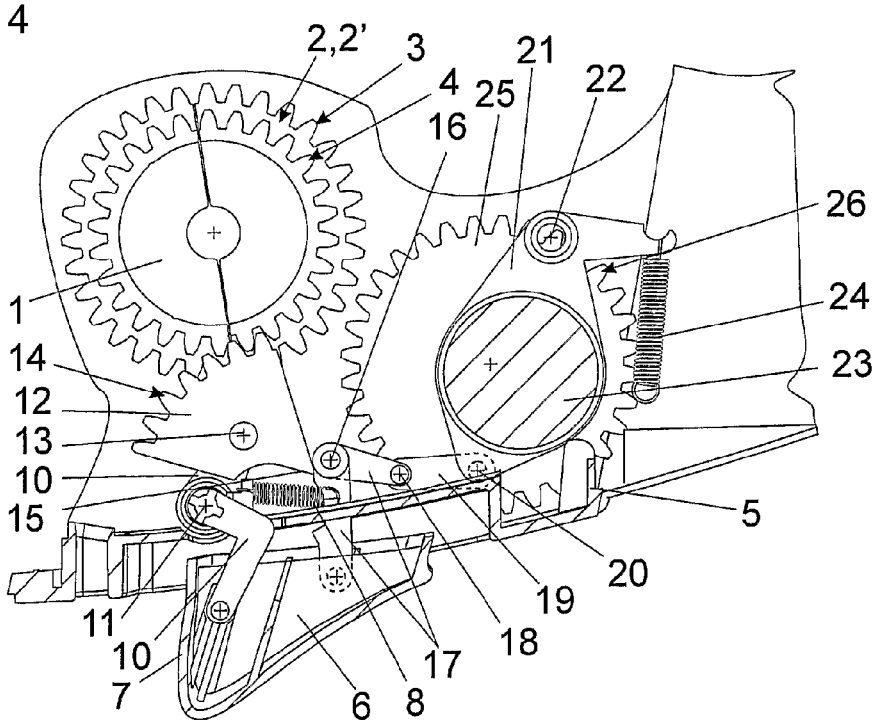
Figure 5:
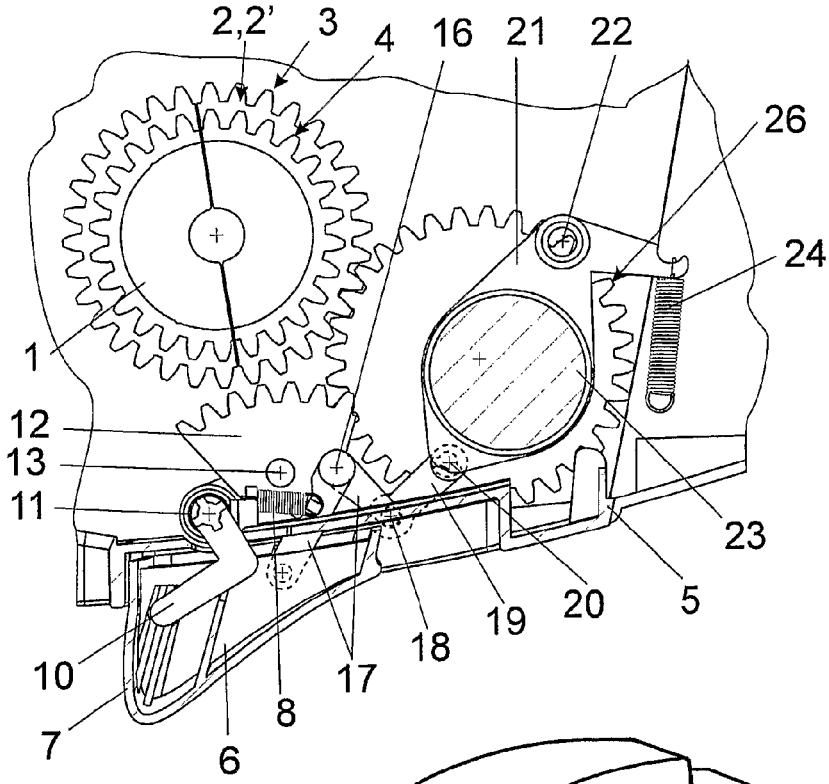

The embodiment according to FIGS. 1 to 5 is advantageous in particular wherever there is little space in the dispenser, since, even in the maximum position of the coupling element 6 and of the motor 23 that is apparent in FIGS. 3 and 4, the deviating displacement of the plate 21 is only slightly larger than required for releasing the toothed engagement.

Figure 7:
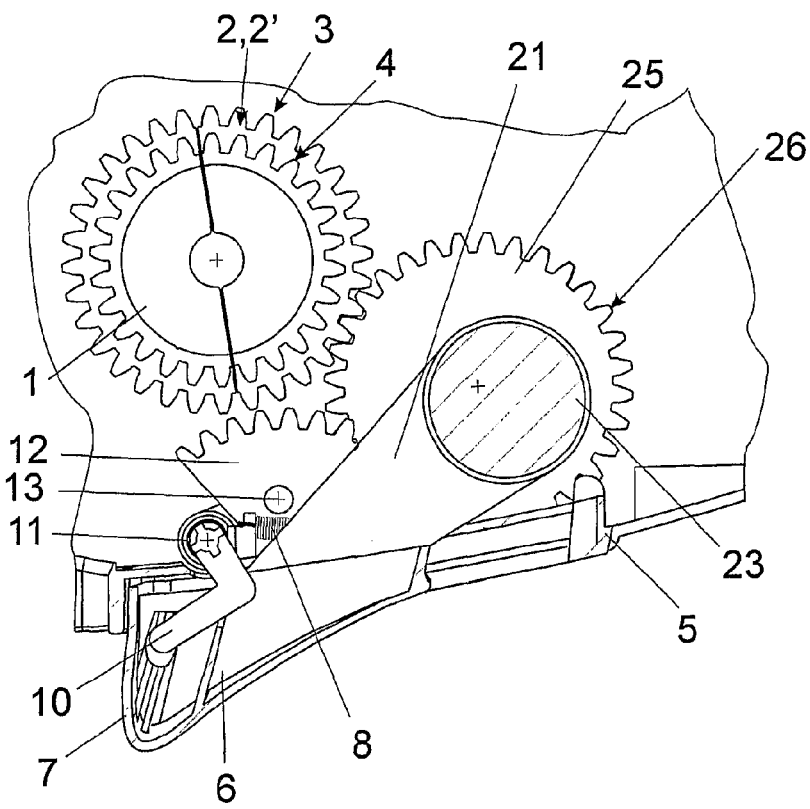
FIG. 7 is a section showing a second embodiment of the driving unit.

FIG. 7 shows a solution which can be used in a clearance and comprises fewer components. In this embodiment, the plate 21 supporting the motor 23 is rigidly connected to the coupling element 6 and the latter is guided in a linearly displaceable manner in the housing 5. The two-armed lever 10 again pivots the toothed segment 12 which is urged by a spring into the buckled position shown in FIG. 7. A guide slot in which the first lever arm 10 engages is formed in the coupling element 6. The sequence of movement is the same as in the first embodiment. If the coupling element 6 is displaced to the rear, the gear wheel 25 is disengaged from the toothed ring 3 until the toothed segment 12 engages in the toothed ring 4 of the first coupling member 2. A further pivoting of the coupling element 6 rotates the conveying roller 1, with the motor 23 being displaced at the same time to the rear into the free space.

Figure 10:
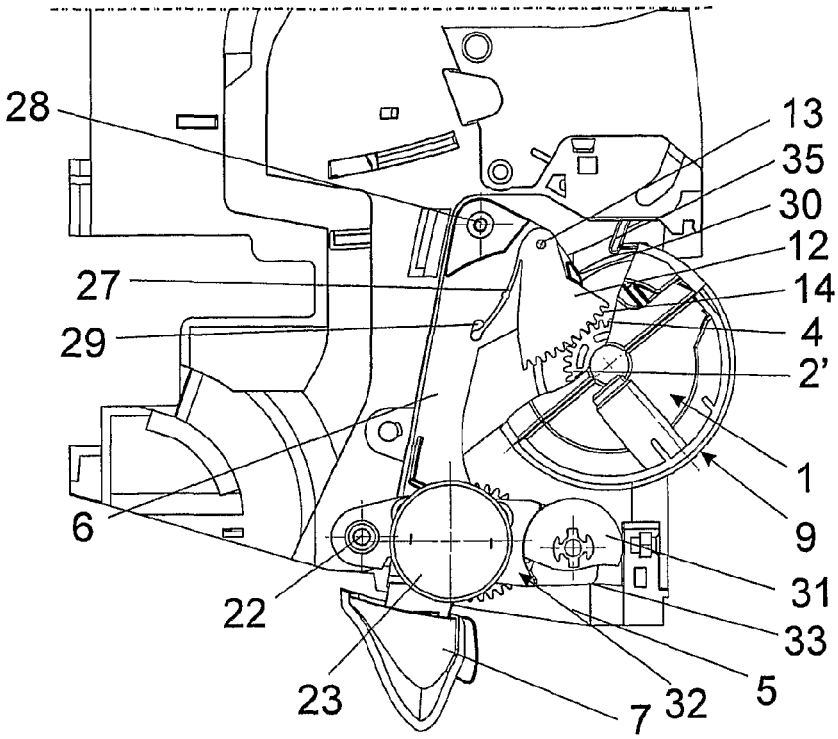

FIGS. 8 to 11 show a further exemplary embodiment in which the actuating element 7 is assigned to a coupling element 6 which is formed by a single-armed lever and is pivotable about an axis 28 lying above the conveying roller 1. In the vicinity of the axis 28, an axis 13 for the toothed segment 2 is provided spaced apart approximately horizontally on the coupling element 6, the axis 13, as a result, primarily moving up and down during the pivoting of the coupling element 6. The toothing 14 of the toothed segment 12, which is disengaged from the toothed ring 4 in FIG. 8, therefore engages, after a short pivoting displacement of the coupling element 6, in the toothed ring 4 of the first coupling member 2', as is apparent from FIG. 9. The toothed segment 12 forming the second secondary coupling member of the manual drive has a spring arm 27, the end of which is guided in an elongated hole 29 in the coupling element 6 such that the toothed segment 12 is pressed against a stop 35 of the housing 5 in the standard position according to FIG. 8. During the pivoting of the coupling element 6, the stop 30 then becomes effective on the coupling element 6 itself which pivots together with the stop and therefore, as shown in FIG. 10, causes the rotation of the conveying roller 1 by means of the pivoting of the toothed segment 12.

Figure 8:
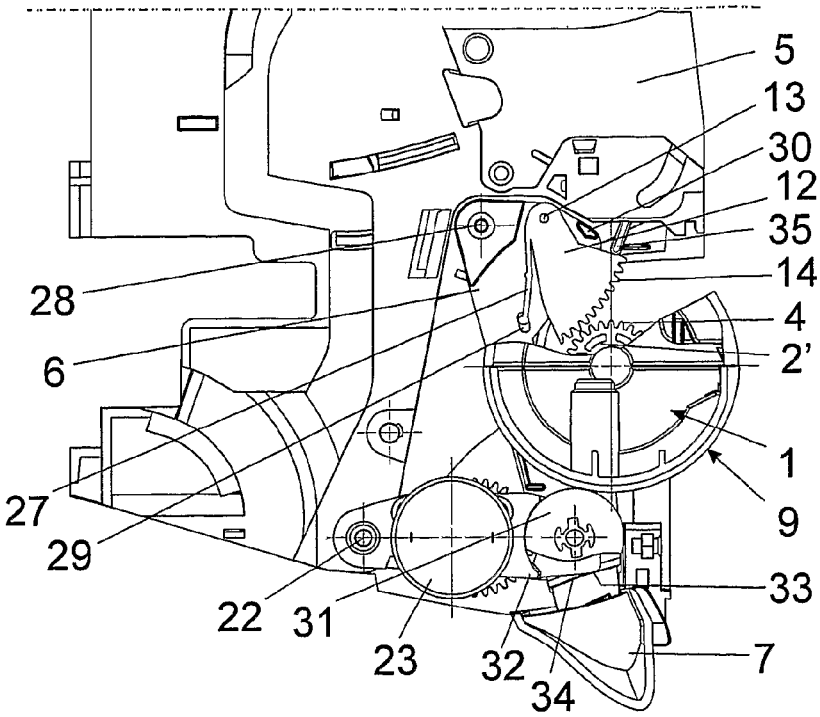
FIGS. 8 to 11 show identical sections in four different positions of a further embodiment of the invention.
Figure 9:
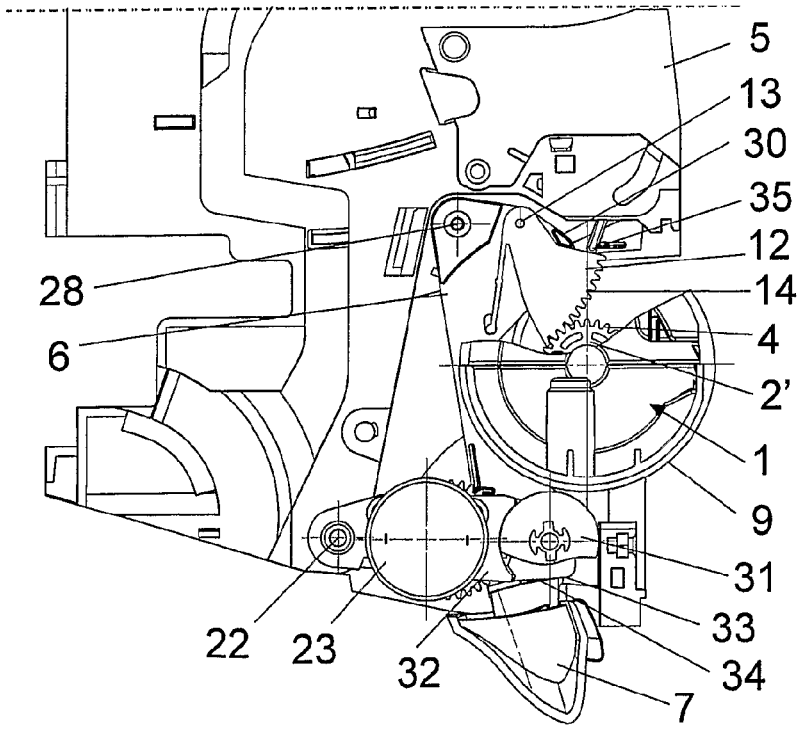
Figure 11:
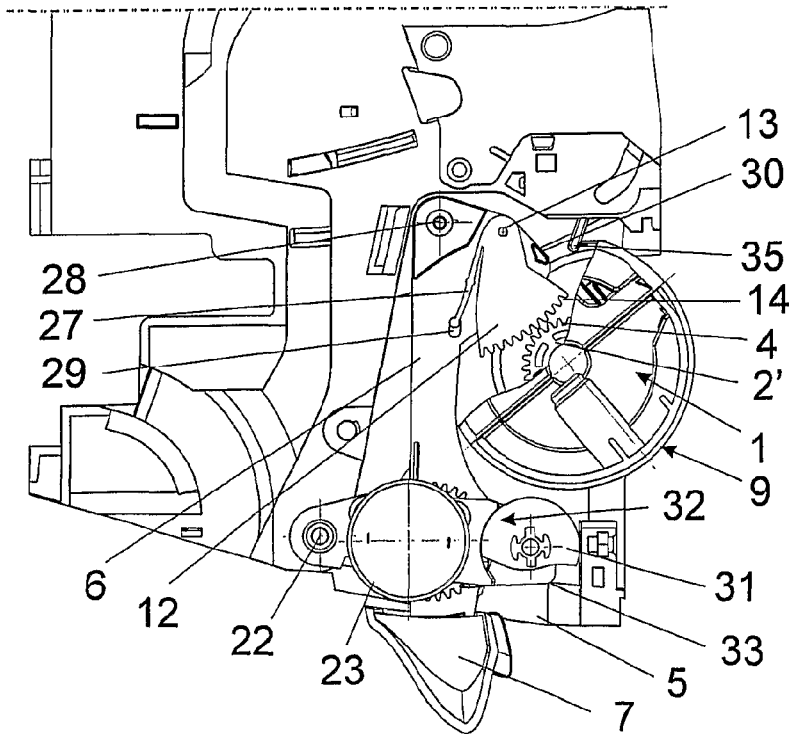

The motor 23 is arranged on an approximately horizontal support 32 which is pivotable about the axis 22, the support 32 having a ramp 33 resting on a projection 34 of the coupling element 6. Both the coupling element 6 and the support 32 preferably have arms mounted on the side walls of the dispenser housing 5 on both sides, and are therefore designed in the manner of a clip, with the side arms of the coupling element 6 being connected by the actuating element 7 which protrudes at the front of the lower side. The front ends of the arms of the support 32 support the first secondary coupling member 31 of the motorized drive which is formed in the embodiment according to FIGS. 8 to 11 by a friction roller which presses against the circumferential periphery of the conveying roller 1 and is driven by the motor 23. FIG. 8 shows the standard position in which the friction roller 31 is in engagement with the circumference 9 of the conveying roller 1 which, in this embodiment, forms the first coupling member for the motorized drive. A friction-increasing coating or the like can preferably be provided for this purpose. The ramp 33 and the bearing 34 are positioned in such a manner that the lowering of the bearing 34 at the beginning of the pivoting movement of the coupling element 6 interrupts the frictional connection between the conveying axis 1 and the friction axis 31 before the toothings 14 and 4 intermesh. Similarly, during the pivoting back of the coupling element 6 into the starting position, the frictional connection of the motorized drive is restored only in the final area of the pivoting displacement, in which the vertical component thereof becomes greater. The coupling element 6 is provided with a resetting spring (not shown), for example with a leg spring on the axis 28. FIG. 11 shows the position of the parts at approximately half of the return path of the coupling element 6. Since the conveying roller 1 is not rotated back, the pivot axis 13 of the toothed segment 12 rises and the spring arm 27 slides upward in the elongated hole 29, as a result of which the meshing of the teeth 14 and 4 are disengaged.

Since the lifting movement by itself is not sufficient at the beginning, the toothed segment 12 can yield to the left about the axis 13 counter to the action of the spring arm 27, in which case it lifts off from the stop 30, as is apparent from comparing FIGS. 10 and 11.

The invention claimed is:

1. A paper dispenser, comprising:

a conveying roller;

a first coupling member connected to said conveying roller for actuating said conveying roller;

a motorized drive and a manual drive for alternatively rotating said conveying roller;

a first secondary coupling member assigned to and actuated by said motorized drive and a second secondary coupling member assigned to and actuated by said manual drive;

a movable coupling element connecting said first and second secondary coupling members to one another; and an actuating element for moving said movable coupling element, wherein, by moving said movable coupling element, said secondary coupling members may be brought alternatively into engagement with said first coupling member, to enable said conveying roller to be alternatively rotated by the motorized drive or by the manual drive.

2. The paper dispenser according to claim 1, wherein said conveying roller has two identical first coupling members disposed to interact with two identical secondary coupling members.

3. The paper dispenser according to claim 1, wherein said conveying roller has two mutually different first coupling members disposed to interact with two mutually different second coupling members.

4. The paper dispenser according to claim 1, wherein said first coupling member is formed with a toothing, and said second secondary coupling member of the manual drive is a toothed segment meshing with said toothing.

5. The paper dispenser according to claim 4, wherein said toothed segment is pivotally disposed by way of a two-armed lever coupled to said movable coupling element.

6. The paper dispenser according to claim 5, wherein said toothed segment is pivotally mounted on said two-armed lever.

7. The paper dispenser according to claim 4, wherein said movable coupling element is a single-armed lever on which said toothed segment is pivotally mounted.

8. The paper dispenser according to claim 1, wherein said first coupling member is formed with a toothing, and said second secondary coupling member of the motorized drive is a spur gear wheel meshing with said toothing.

9. The paper dispenser according to claim 8, wherein said spur gear wheel is arranged together with a motor on a plate and said plate is pivotable by said coupling element.

10. The paper dispenser according to claim 9, which comprises a second two-armed lever coupled to said coupling element and connected via an intermediate lever to said pivotable plate.

11. The paper dispenser according to claim 10, wherein a second arm of said second two-armed lever and said intermediate lever form a toggle lever having two dead center positions formed by respective ends of a guide slot.

12. The paper dispenser according to claim 9, which comprises a restoring spring disposed to act upon said plate.

13. The paper dispenser according to claim 1, wherein said first coupling member is provided on a circumferential surface of said conveying roller, and said first secondary coupling member of the motorized drive is a friction roller disposed to press against the circumferential surface of said conveying roller.

14. The paper dispenser according to claim 13, wherein said friction roller and a motor driving said friction roller are mounted to a support and said support is pivotable by said coupling element.

15. The paper dispenser according to claim 1, which comprises a manually actuable slide, and wherein said coupling element is connected to said manually actuable slide.

16. The paper dispenser according to claim 15, which comprises a restoring spring disposed to act upon said slide.

17. The paper dispenser according to claim 1, wherein said movable coupling element is pivotable about an upper axis and protrudes downward and is pivotable counter to a resetting spring by way of a slide, wherein a support together with a motor and a driving roller are arranged approximately horizontally and are liftable and lowerable in a sliding manner on said movable coupling element, and wherein a toothed segment is arranged on a pivot axis spaced apart approximately horizontally from said upper axis of said coupling element and is likewise liftable and lowerable.

* * * * *